United States Patent [19]

Moseley, Jr. et al.

[11] Patent Number: 4,614,303

[45] Date of Patent: Sep. 30, 1986

[54] WATER SAVING SHOWER HEAD

[76] Inventors: Charles D. Moseley, Jr., P.O. Box 449, Lynchburg, Va. 24505; Charles D. Waring, 3952 Bosworth Dr. SW., Roanoke, Va. 24014

[21] Appl. No.: 625,636

[22] Filed: Jun. 28, 1984

[51] Int. Cl.[4] ..... B05B 1/26; B05B 1/30; B05B 1/14

[52] U.S. Cl. ..... 239/499; 239/579; 239/581; 239/590.3; 239/590.5

[58] Field of Search ..... 138/44; 239/579, 581, 239/590.3, 590.5, 456, 458, 457, 104, 106, 499, 460

[56] References Cited

U.S. PATENT DOCUMENTS

| | | | |
|---|---|---|---|
| 2,568,515 | 9/1951 | Scheiwer | 239/458 X |
| 2,985,385 | 5/1961 | Bowers et al. | 239/499 X |
| 3,102,691 | 9/1963 | Gall | 239/581 X |
| 3,796,377 | 3/1974 | O'Hare | 239/460 X |
| 3,894,562 | 7/1975 | Mosely, Jr. et al. | 138/44 |
| 3,999,714 | 12/1976 | Lang | 138/44 X |
| 4,360,160 | 11/1982 | Jette | 239/579 X |

FOREIGN PATENT DOCUMENTS

| | | | |
|---|---|---|---|
| 452224 | 8/1936 | United Kingdom | 239/458 |

*Primary Examiner*—Andres Kashnikow

*Assistant Examiner*—Mary Beth O. Jones

*Attorney, Agent, or Firm*—Lowe, Price, LeBlanc, Becker & Shur

[57] ABSTRACT

A self-cleaning, water saver shower head which will provide a maximum flow rate without regard to water pressure and which may be adjusted from a no flow condition to a fine mist to a spray to a heavy pulsating rinse stream. The device uses a cavitation inducing orifice at the inlet to the head and a second cavitation inducing set of orifices upstream of the outlet with an elongated mixing chamber therebetween. A plunger is disposed in the outlet downstream of the second cavitation inducing orifices to direct the water exiting the device against a diffuser sleeve to define the spray. Rotation of a sleeve which defines the outlet and carries the diffuser causes axial displacement of the plunger within the outlet to provide the desired spray. In an embodiment of this invention, instead of a no flow condition, a drip condition will be produced by rotating the sleeve to cause axial displacement of the plunger until a knurled flange seats at the outlet thereof. Serrations on the flange permit a drip of water to pass therethrough so that when the shower head is in the drip position, a stream of water will not be permitted therethrough, but the water behind the shower head will not rise to the temperature of the hot water.

5 Claims, 5 Drawing Figures

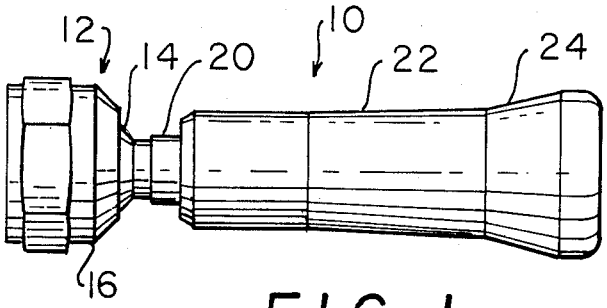
FIG. 1
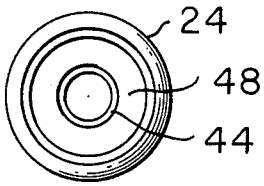
FIG. 2
FIG. 4
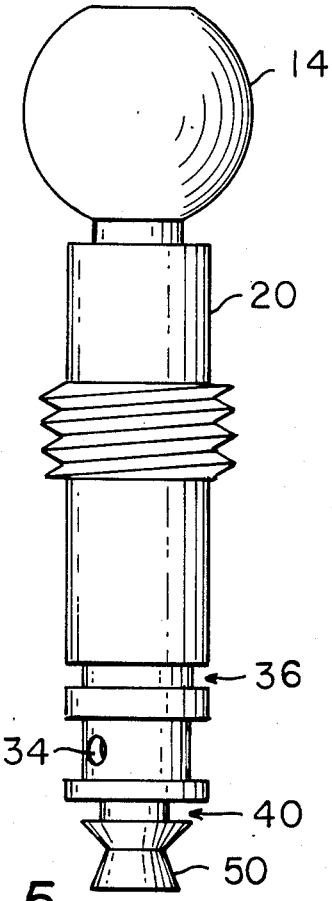
FIG. 5
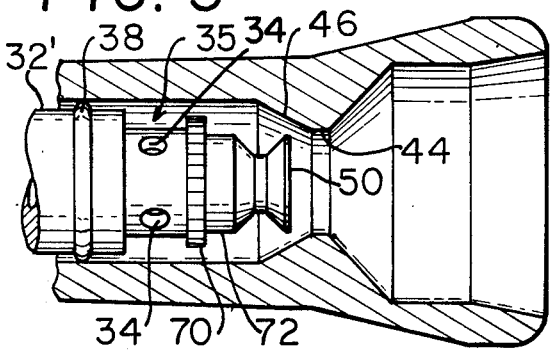
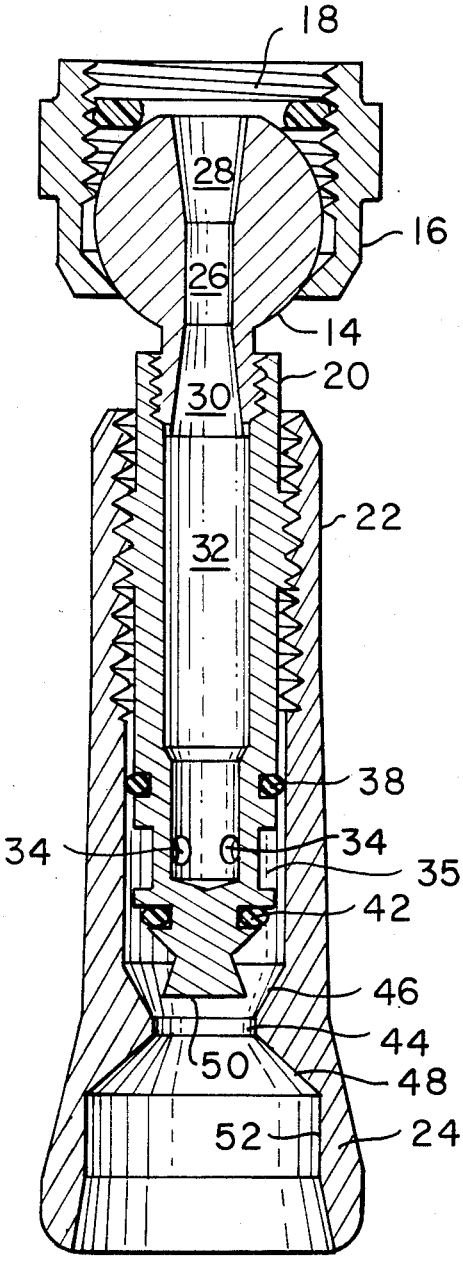
FIG. 3

WATER SAVING SHOWER HEAD

This invention relates to a shower head which combines an internal self-cleaning action and the ability to generate a variable spray as desired. The shower head also includes a water saving function and an integral shut-off whereby the spray may be varied from a fine, variable spray, to a coarse spray, to a powerful needle stream, to a heavy rinse stream that pulsates. At low system pressure the head of this invention has the ability to increase velocity to compensate for such low pressure, and has a water saving effect which, depending upon the internal dimensions, will permit a fixed flow rate maximum which is not dependent upon pressure.

In my prior U.S. Pat. No. 4,054,157, and a related joint U.S. Pat. No. 3,894,562, there are disclosed fluid flow controllers which are effective to limit the flow of liquid through a conduit to a predetermined rate. The controllers operate on a principle of cavitation and in general provide three serially connected chambers. The first chamber is a convergent chamber which causes the liquid to converge into a short tube orifice cavitation chamber which then opens into a diffusing chamber. As liquid flows through the device then induced cavitation limits the flow to a predetermined rate, and the diffusing chamber eliminates the cavitation so that downstream conduit is not damaged. Such a device, inserted in a conventional shower head, for example, will limit the flow thereto to a maximum of, for example, 4 gallons per minute regardless of the water pressure. Under low pressure conditions the increased velocity gives the illusion of an increased flow.

It has been discovered that the principle of cavitation may also be adapted to provide a self-cleaning shower head which preserves the water saver function and provides a self-cleaning action without moving parts. In addition, the shower head of this invention is adapted to compensate for a low flow of water by providing a high velocity shower stream. In addition, the shower head may be adjusted to form a widely variable spray from an atomized spray to a fine spray to a powerful needle stream to a heavy rinse stream that pulsates merely by rotating the head. The head further may be rotated to an off position without a separate switch.

The self-cleaning function, provided by cavitation, ensures that lime and minerals in the water will not clog the head. Cavitation, as is described in my above prior patents, may be used to ensure a maximum flow rate and the self-cleaning action. The device of this invention, however, induces cavitation at the entrance to the shower head and upstream the exit port. Cavitation in the latter instance, in addition to providing a self-cleaning action, further produces the high velocity needed in low water pressure situations and fosters with a diffusion sleeve and plunger the desired spray without a foraminous plate or other similar device used to promote a spray at the shower exit port in conventional shower heads.

The only moving part in the shower head of this invention is a sleeve which surrounds the plunger and forms the diffusion chamber at the exit port. Rotation of this sleeve, as will be subsequently explained, controls the distance between the plunger and the exit port which in turn controls the type of spray desired or when the plunger is seated in the exit port, operates to cut off the flow of water from the device.

Accordingly, it is an object of this invention to provide a simple and efficient water saver shower head.

It is another object of this invention to provide a water saver with internal scrubbing action which is self-cleaning without moving parts.

It is still another object of this invention to provide a water saver shower head with a variable stream from a no-flow condition to a fine spray to a needle spray to a pulsating spray.

It is still another object of this invention to provide a water saver shower head which will permit a flow not to exceed around 3-½ to 4 gallons per minute regardless of water pressure, and which at low flow conditions such as 0.75 to 1.0 gallons per minute will exhibit sufficiently high velocity to provide the illusion of a much higher flow rate and which, when desired, may be quickly cut off without a separate switch or without adjusting the shower valves.

It is yet another object of this invention to provide a water saver shower head which incorporates upstream and downstream cavitation inducing means to regulate the flow therethrough, induce a high velocity to the water stream, and provide a self-cleaning scouring action against lime and minerals in the water without moving parts or mechanical action.

These and other objects will become readily apparent with reference to the drawings and following description, wherein:

FIG. 1 is a plan view of the shower head of this invention;

FIG. 2 is a right side view of the shower head of FIG. 1;

FIG. 3 is a cross-sectional view of the shower head of this invention;

FIG. 4 is a plan view of the internal stem and plunger with integral ball portion of a ball joint for attachment to a source of water under pressure.

FIG. 5 is a fragmentary cross-sectional view of an alternate embodiment of the shower head of this invention.

With attention to the drawings and to FIG. 1, the shower head of this invention 10 includes a conventional ball joint 12 consisting of a ball 14 received in a socket 16 which, as shown in FIG. 3, mounts internal threads 18 for attachment to a conventional threaded water pipe (now shown) by rotation thereof.

Ball 14 is mounted on a stem 20 which is threadedly received within a sleeve 22. Sleeve 22 forms at the outlet of the shower head a hollow diffuser 24 which, as will be subsequently explained, forms the desired spray.

With attention to FIG. 3, ball 14, with stem 20, forms an inlet cavitation chamber 26. Upstream of chamber 26 a convergent chamber 28 is provided, and downstream of cavitation chamber 26 a diffusing chamber 30 is provided. Water then from a water pipe (now shown) enters the convergent chamber 28 and cavitates through cavitation chamber 26. As the water enters diffusion chamber 30 the cavitation dissipates so that the interior of shower head 10 will not be subject to pitting or other damage normally associated with undiffused cavitation flows. As described in my prior patents noted above, chambers 26, 28 and 30 are self-cleaning due to cavitation and the water flow therethrough, also due to cavitation, will not increase beyond the flow rate at which cavitation occurs. As is well known, cavitation occurs when the liquid pressure equals the vapor pressure of the liquid. Pockets of air are then formed at the interface between the liquid and surrounding chamber walls.

Cavitation will induce precipitation of dissolved minerals and the like, but the turbulence generated thereby will cause this precipitant to pass on through the cavitation chamber 26 whereupon the cavities formed dissipate in diffusion chamber 30 and the water stream then enters a mixing chamber 32 which extends axially through the interior of stem 20 to exit ports 34. Exit ports 34 are in fact sharp edged orifices and there are four in number disposed at 90 degree angles around stem 20.

With reference to FIG. 4, stem 20 forms an upper groove 36 above exit ports 34 for receiving an O-ring 38 as shown in FIG. 3. O-ring 38 then seals the interior of the upper portion of shower head 10.

Below exit ports 34 a second groove 40 is formed for receiving an O-ring 42 as shown in FIG. 3. Sleeve 22 forms an exit port 44 which is a constriction having a converging walled inlet 46 and a diverging walled outlet 48. When sleeve 22 is rotated on stem 20 to retract the sleeve over the stem, O-ring 42 will encounter converging walls 46 to seal the outlet 44. In this way the flow of water through the device 10 of this invention can be cut off merely by rotating sleeve 22.

Stem 20 terminates in a frustro conical plunger head 50 which with the diffuser portion 24 of sleeve 22 functions to define the flow or spray desired. The outlet orifices 34 also induce cavitation of the water exiting the mixing chamber 32. As the water circulates around plunger head 50 and through outlet opening 44 into the diverging section 48 and the interior tapered walls 52 of diffuser section 24 the spray, depending upon the velocity, will be defined. Cavitation in this case then not only maintains the openings 34, but increases the velocity so that the device of this invention may provide a spray adjustable from a mist to a needle spray 2, when plunger 50 is fully retracted into the interior of sleeve 22 a rinsing stream which because of cavitation and the wall effect achieved against the interior of diffusion section 24 will pulsate. The heavy rinse pulsating stream gives the effect of a high flow rate, but because of the cavitation chamber 26 the flow rate is limited by the dimensions of the device. Accordingly, the illusion of a high flow rate will be achieved even though in reality the flow rate is limited to, for example, 3.5 to 4.0 gallons per minute.

Diffuser 24 functions to provide a flow pattern roughly in the shape of the diffuser wall 52. As water exits outlet 44 it will by surface tension follow wall 52 as it flows through diffuser section 24. The plunger 50 is frustro conical in order to assist in directing the flow of water against walls 48 and 52. As the sleeve 22 then is rotated, plunger 50 will enter or retract from the opening 44 to change the flow pattern therethrough. As noted above, when plunger 50 is fully retracted within sleeve 22 a heavy rinse stream will be produced which pulsates. In contrast, when plunger 50 is fully received within outlet opening 44, O-ring 42 will abut wall 46 to shut off the flow of water through the outlet opening 44.

In a preferred version of the device of this invention the mixing chamber 32 is about $1\frac{3}{4}''$ long. Four outlet openings 34 of about $\frac{1}{8}''$ in diameter are provided to function as thin edged orifices in order to produce cavitation as the velocity increases when the water passes therethrough. The diffuser outlet opening 44 is about 9/32 inches in diameter, whereas the plunger head at its base is about 0.244 inches in diameter. The overall length of sleeve 22 is about 2-11/16 inches. The dimensions of the inlet cavitation chamber, convergent chamber and diverging chambers 26, 28, and 30 are in accordance with the teachings of my above patents. The three chambers in length total 0.822 inches. The device preferably is constructed of brass with the sleeve 22 being constructed of a brass aluminum alloy such as No. 614D, which will provide more elasticity. The stem may be, for example, brass No. 360.

With attention to FIG. 5, it has been discovered that when two ports 34 are provided instead of four the maximum flow rate will be reduced. For example, in the embodiment shown in FIGS. 1–4, four ports 34 are provided, and the maximum flow rate is about 3 gallons per minute. However, by reducing the numbers of ports 34 to two as shown in FIG. 5, the maximum flow rate will be reduced to $2\frac{1}{2}$ gallons per minute. Once the maximum flow rate has been reached, an increase in pressure will not increase the flow rate, due to cavitation, as described above.

In addition, in the device shown for example in FIG. 3, O-ring 42 will engage the sloping wall 46 to thereby close off a flow of water through outlet opening 44. This results in a build-up of heat in the water line behind the shower head 10. When the stem 32 is retracted, then a gush of hot water will flow through opening 44. Users may find this gush of hot water to be undesirable.

Accordingly, in the embodiment of FIG. 5, the O-ring 42 has been replaced by a knurled flange 70. Flange 70 forms with stem 20 the mixing chamber 35. When the plunger 50 enters the outlet 44 the plunger head will extend therethrough until knurled flange 70 encounters the converging walls 46. At this point the flow of water through outlet 44 will be extremely constricted, but not eliminated. The head will then continue to drip until plunger 50 is retracted. By continuing to drip, the heat in the water line will not be permitted to increase to the point of causing discomfort to the user when the shower head is turned on. The difference then between the embodiment of FIG. 5 is that the O-ring 42 in groove 40 is replaced and a straight shaft portion 72 results from the elimination of groove 40. The remaining flange is then knurled so that water behind the flange 70 will find its way through outlet 44 in a drip fashion. In addition, the embodiment of FIG. 5 depicts two ports 34 instead of four, and it should be understood that this invention is not intended to be limited to the number of ports 34 formed to release water from mixing chambers 32 or 32' to exit the shower head at outlet 44.

The device of this invention then achieves the objectives thereof by combining inlet and outlet cavitation. The result is that the maximum flow rate through the device will be controlled, and sufficient velocity induced to the exit stream so as to provide an illusion of a high volumetric flow rate. The inlet cavitation chamber 26 is a short tube orifice, whereas the outlet cavitation is provided by four thin-edged orifices in outlet ports 34. The exit stream by wall attachment effect produces a control flow pattern by action of a diffuser at the exit port. Water spray leaving exit port 44 by surface tension follows the interior wall of the diffuser to form this pattern.

Cavitation induced at the entrance and exit has been found to be sufficient to provide the desired enhanced velocity, but not strong enough to cause damage to the interior of the device. When water passes through an orifice and the pressure approaches vapor pressure, air pockets will form and dissolved minerals will tend to precipitate. The diffusing chamber 30 downstream of the cavitation chamber 26 is provided in order to dissipate such cavities. Similarly, when the water exits ports 34 it enters a chamber 35 wherein the turbulence tends to collapse the cavities formed. The cavitation, however, has the desired cleaning action at both the inlet and the outlet to keep them free from mineral deposits and lime. The device of this invention then is self-cleaning without the provision of mechanical parts. There is only a single moving part, and that is the threadedly received external sleeve 26 which mounts the diffuser and functions to define the shower spray and provide adjustment thereof.

Accordingly, the device of this invention will provide a much more adjustable shower head with water saving features and self-cleaning features and only a single moving part.

The invention may be embodied in other specific forms without departing from the spirit or essential characteristics thereof. The present embodiment is, therefore, to be considered in all respects as illustrative and not restrictive, the scope of the invention being indicated by the appended claims and all changes which come within the meaning and range of equivalency of the claims are, therefore, intended to be embraced therein.

What is claimed is:

1. A self-cleaning, water saver shower head which is adjustable between a drip flow condition, a fine spray, a powerful spray and a heavy, pulsating rinse stream comprising:

an elongated, substantially hollow housing having an axial inlet port at one end for admitting water, a plurality of radial outlet ports adjacent the opposite end for expelling water and an interior mixing chamber in communication with the inlet port and the radial outlet ports; first cavitation means disposed at the inlet for inducing cavitation in a stream of water passing therethrough and second cavitation inducing means disposed at the radial outlet ports for inducing cavitation in a stream of water passing therethrough;

a hollow sleeve rotatably mounted on the exterior of said housing surrounding the radial outlet ports, said sleeve including spray diffusing means extending axially outwardly from the ends of said housing adjacent the radial ports for collecting streams of water from said radial ports and dispensing the same in a spray pattern, said sleeve also mounting spray adjustment means disposed between the radial ports and said diffusing means for changing the spray pattern from said diffusing means responsive to rotation of said sleeve about said housing;

said sleeve further comprising an internal throat, an internal converging chamber upstream of the throat, and an internal diverging chamber downstream of the throat, said diverging chamber opening into a diffusing flange which forms the spray outlet of said head, the radial outlet ports of said housing being disposed within said sleeve upstream of the converging chamber;

said spray adjustment means further comprising a frustroconical plunger formed by the end of said housing adjacent the radial outlet ports and disposed downstream of the ports adjacent the throat whereby as said sleeve is rotated on said housing the plunger will move, selectively, into or out of the throat thereby changing the spray pattern therethrough; and drip constricting means surrounding said housing between the plunger and the radial outlets for engaging the surface of the converging chamber when the plunger is fully received in the throat to constrict the flow of water therethrough to a drip said drip constriction means comprising a flange extending radially outwardly from said housing, the peripheral surface of said flange defining knurled serrations so that when said flange seals against the converging chamber surface of said sleeve adjacent the throat the flow of water through said shower head will be restricted to a drip.

2. The device of claim 1 wherein said first cavitation means includes a short tube orifice disposed in the inlet port so that water entering said housing must pass through the orifice.

3. The device of claim 1 wherein said housing is substantially cylindrical and said plurality of radial ports comprises four radially directed ports disposed at 90° degree intervals around the longitudinal axis thereof.

4. The device of claim 3 wherein said second cavitation means includes a sharp edged orifice disposed in each radial outlet port.

5. The device of claim 1 wherein said housing is substantially cylindrical and said plurality of radial ports comprises two radially directed ports disposed at 180° degree intervals around the logitudinal axis thereof.

* * * * *